United States Patent [19]

Wilson

[11] Patent Number: 4,884,429

[45] Date of Patent: Dec. 5, 1989

[54] DECELERATOR APPARATUS FOR HOT ROLLED PRODUCT

[75] Inventor: Alexander I. Wilson, Sheffield, England

[73] Assignee: Morgan Construction Company, Worcester, Mass.

[21] Appl. No.: 117,623

[22] Filed: Nov. 5, 1987

[30] Foreign Application Priority Data

Nov. 14, 1986 [GB] United Kingdom ..... 8627279

[51] Int. Cl.[4] ..... B31B 39/20

[52] U.S. Cl. ..... 72/250; 72/164; 72/203

[58] Field of Search ..... 72/203, 201, 202, 204, 72/250, 164

[56] References Cited

U.S. PATENT DOCUMENTS

| | | | |
|---|---|---|---|
| 2,179,461 | 11/1939 | Yoder | 72/203 |
| 2,214,618 | 9/1940 | Kenyon et al. | 72/203 X |
| 2,809,545 | 10/1957 | Norlindh | 72/203 |
| 3,258,951 | 7/1966 | Kinnicutt, Jr. et al. | 72/203 |
| 4,176,535 | 12/1979 | Elsner et al. | 72/203 X |
| 4,719,781 | 1/1988 | Cloup | 72/164 |

FOREIGN PATENT DOCUMENTS

| | | | |
|---|---|---|---|
| 0718204 | 2/1980 | U.S.S.R. | 72/164 |
| 0730425 | 5/1980 | U.S.S.R. | 72/164 |

*Primary Examiner*—W. Donald Bray

*Attorney, Agent, or Firm*—Samuels, Gauthier, Stevens & Kehoe

[57] ABSTRACT

Decelerator apparatus acting to reduce the distance over which lengths of hot rolled product slide before coming to a halt on leaving a rolling mill stand.

So as to avoid the use of pinch rolls or the like, the apparatus employs deforming rollers acting on a leading length of said rolled product in a direction perpendicular to its length and a shear for severing the leading length of product from a following length being acted on by said rolling mill stand whilst said rolls are still in motion.

11 Claims, 5 Drawing Sheets

DECELERATOR APPARATUS FOR HOT ROLLED PRODUCT

BACKGROUND OF THE INVENTION

1. Field of the Invention

The invention relates to decelerator apparatus for hot rolled product being produced in a rolling mill.

2. Description of the Prior Art

Rolled product generally leaves the finishing stand of a rolling mill at a speed roughly inversely proportional to its cross sectional area so as to maintain as near as possible a constant rolling rate in terms of tonnage of finished product produced.

When rolled product is delivered in straight lengths from the finishing stand it is cut into the lengths required and these then have to be brought to rest before being transferred sideways across a cooling bed. However, it will be understood that the smaller the cross sectional area of the rolled product, the greater is the rolling speed and consequently the greater is the stopping distance required before the lengths of product can be moved sideways onto the cooling bed. There is obviously a practical limit to the distance over which the lengths of product can be allowed to decelerate and the time this takes which has to be within the cycle time of products being delivered from the mill less time for the bed to clear the first notch of the cooling bed. The result is that in many of the higher production rolling mills it is found that the rolling rate in terms of tonnage produced per hour drops substantially when product of relatively small cross sectional area is being produced purely because of the high output speed of the product from the finishing stand.

Various attempts have been made to solve this problem. For example, so-called double lifting aprons associated with walking beam type cooling beds have been used, and have reduced the sliding time of the lengths of product on the take off apron immediately following the finishing stand and also before the first rake. In other words, the total sliding time of a length of rolled product has been shared between the two systems, but in fact the overall sliding distance has not been affected to any significant extent. A more positive action not limited by the frictional force which can be generated by the weight of the product on a supporting surface has been used, this involving the provision of so-called pinch rolls between which the lengths of product after having been sheared to length are trapped near to their back ends and, by virtue of the relatively slow running of said pinch rolls, decelerated fairly quickly. However, this has various drawbacks. For example, it is not easy to provide variable controlled deceleration when using pinch rolls because they depend ultimately on indeterminate frictional contact if deformation of the rolled product is to be minimised. Furthermore, the longer the length of rolled product and the greater its weight. Consequently, the greater is the required pressure applied to the surfaces of the product by the pinch rolls. The result is that some marking of the product is always likely to occur and in some cases the trailing end of a length of product can be deformed. In fact the hot rolled product can be pulled in two or severely necked. For this reason the use of pinch rolls is usually limited to the production of relatively short lengths of rolled product of round cross section or a cross section of some other simple shape.

A further braking device which has been used for the braking of lengths of wire which have been produced in a wire rolling mill has included a number of tiltable braking elements equipped with rollers, the device also including mechanism for tilting the tiltable braking elements by a variable amount. Such a device has been used to brake the lengths of wire, after they have been sheared to length, the braking effect being produced solely by the flexing of the wire as it passes through the device. In other words, the braking effect has been due to the deformation of the wire and by the physical work which has been put into the material by such deformation. For this reason, the amount of braking which can thereby be brought about by such a device on hot rolled lengths of material of relatively small cross sectional area is very small indeed and is very largely indeterminate.

SUMMARY OF THE INVENTION

The invention as claimed is intended to provide a remedy. It solves the problem of how to decelerate lengths of hot rolled product in a most convenient and highly determinate manner.

The advantages offered by the invention are, mainly, that it provides a method of and means for decelerating lengths of hot rolled product which greatly reduces the sliding time of the lenghts of product without the use of pinch rolls or the like which could damage the lengths of rolled product. The invention in addition enables the rolling rate in terms of tonnage produced per hour to be much higher than that which has been possible when using conventional decelerator apparatus.

BRIEF DESCRIPTION OF THE DRAWINGS

One way of carrying out the invention is described in detail below with reference to drawings which illustrate, by way of example, one specific embodiment, in which.

DETAILED DESCRIPTION OF PREFERRED EMBODIMENT

Figure 1:
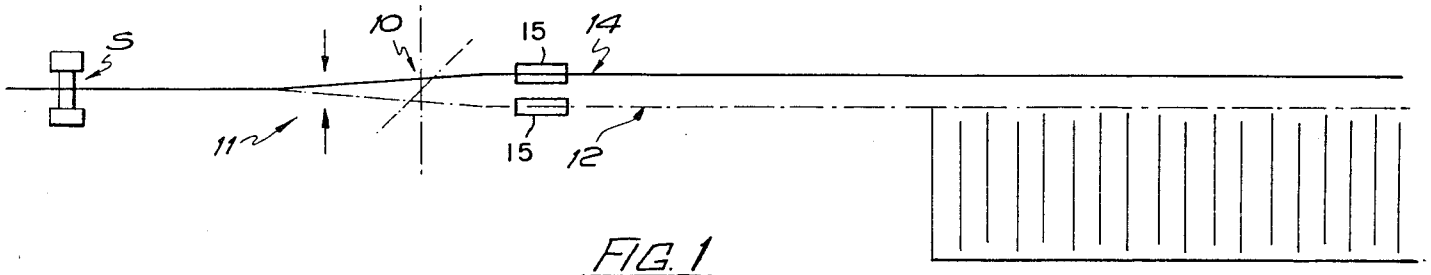
FIG. 1 is a diagrammatic plan view of apparatus embodying the invention.

Referring now to FIG. 1 of the drawings, the decelerator apparatus there illustated is located on the output side of a finishing stand S of a rolling mill producing hot rolled product of relatively small cross sectional area. The apparatus includes switching means, generally indicated 10, for switching successive lengths of product into alternate tracks 12 and 14 for guiding the product as it leaves said finishing stand, the switching means being associated with shearing means, generally indicated 11, for shearing the lengths of product from the rolled product still being acted on by said stand. The switching and shearing means may be of conventional construction, and are arranged to coact with deforming apparatus 15 located along each track 12, 14.

Figure 2:
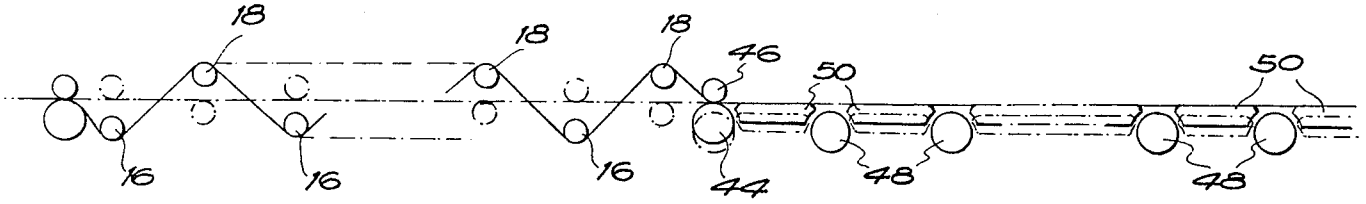
FIG. 2 is a diagrammatic side view of a part of the apparatus of FIG. 1.

In FIG. 2 there is illustrated, in only its bare essentials, a deforming apparatus of the type associated with each of the alternate tracks 12 and 14. Apparatus 15 includes including means for acting on the hot rolled product and deforming it in the sense of bending it. Consequently, said means act on the hot rolled product in a direction perpendicular to its original length, said means being constituted by sets of rollers 16 and 18 on opposite sides of the product. Said rollers are spaced apart in alternate fashion longitudinally of the direction in which the product issues from the finishing stand, as shown. In other words, the rollers on one side of the rolled product are staggered relative to the rollers on the other side. Also associated with each one of the alternate tracks are rollers 48, adapted to be driven at a speed corresponding to the velocity at which the rolled product is to issue from the finishing stand of the mill. Respective sets of lifting aprons 50 are provided between adjacent pairs of rollers 48 along the alternate tracks.

The arrangement is such that the sets of rollers 16 and 18 can be acted upon to move them from the positions in which they are shown in chain-dotted lines in FIG. 2, in which they lie on opposite sides of the rolled product passing, as shown chain-dotted, in straight line fashion from the finishing stand, to the positions in which they are shown in full lines so that the length of rolled product between them is brought to a sinuous form as shown in full lines.

Figure 3:
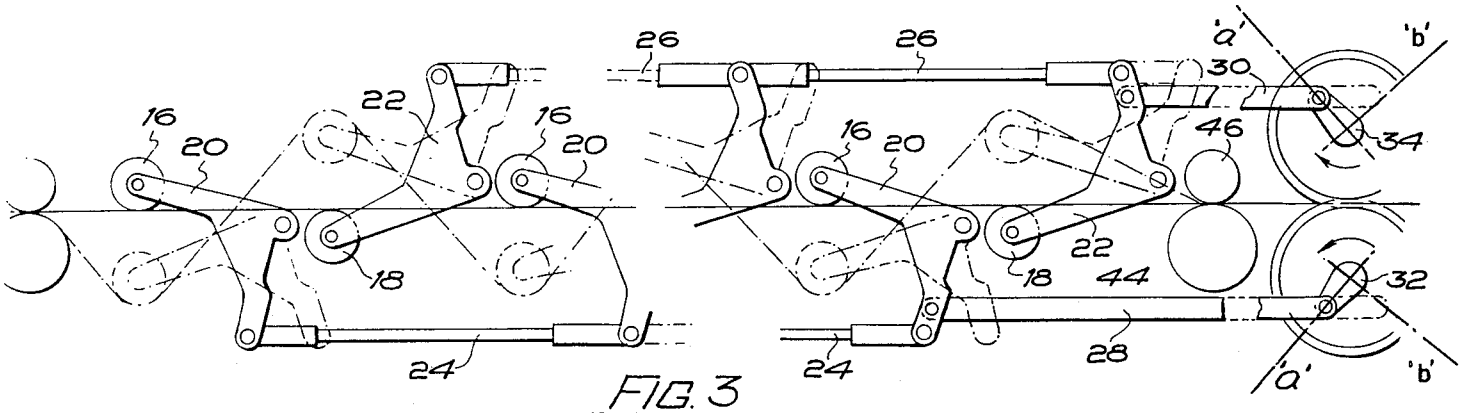
FIG. 3 is a semi-diagrammatic side view of decelerator apparatus forming part of the apparatus of FIG. 2.
Figure 4:
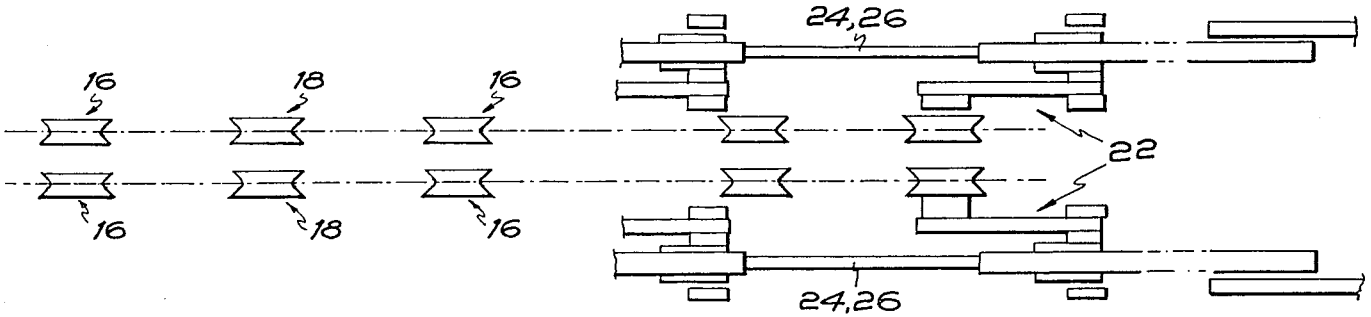
FIG. 4 is a plan view thereof.

Referring now to FIGS. 3 and 4 which still illustrate the invention in only its bare essentials, apparatus for controlling the sets of rollers 16 and 18 include respective sets of bell crank levers 20 and 22 linked together for simultaneous movement by sets of links 24 and 26. An endmost pair of the levers 20 and 22 are linked by means of respective connecting rods 28 and 30 to respective crankshafts 32 and 34 which are geared together, as shown, for contra-rotation. A clutch and brake system (not shown) is used to power the crank shafts in timed relation to the switching means 10 and shearing means 11.

Figure 5:
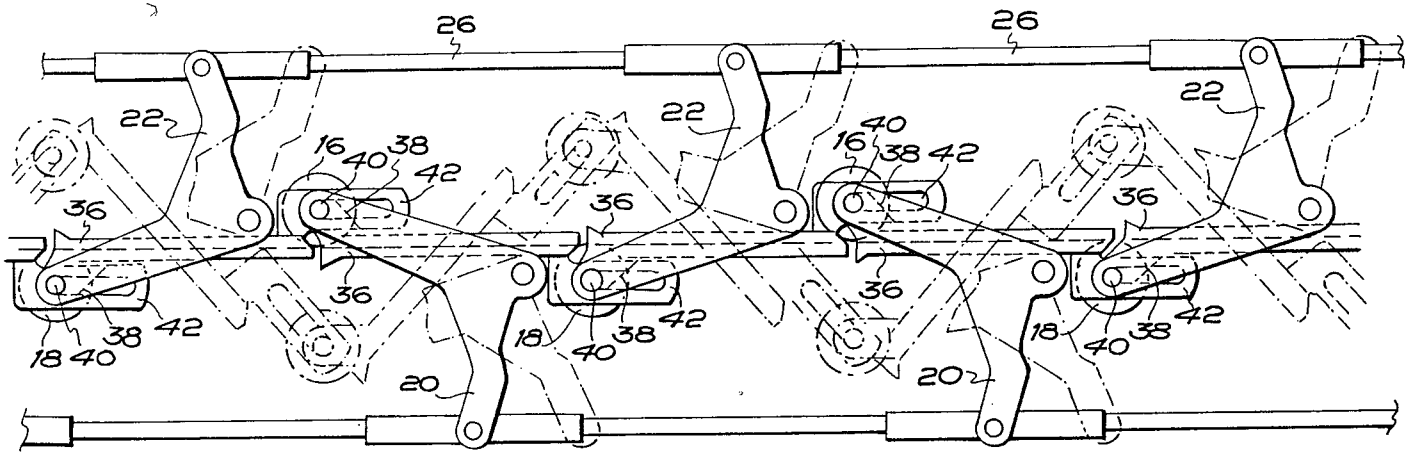
FIG. 5 is a view of part of the apparatus of FIG. 3 and illustrating mechanism omitted from FIG. 3 for the sake of clarity.

Referring now to FIG. 5, this view illustrates mechanism which for the sake of clarity has been omitted from FIGS. 3 and 4, this mechanism being guiding means for guiding the lengths of rolled product along the alternate tracks 12 and 14. Said guiding means are constituted by lengths of tube 36 articulated together to allow the required deformation of the product in a direction perpendicular to its direction of movement from the mill as the sets of rollers are displaced. In fact, as shown, a leading end of each length of tube is connected by means of a pivot bracket 38 to the spindle 40 of the adjacent roller 16 or 18, and a trailing end of each length of tube has sliding connection with the spindle 40 of the next successive roller by means of a slotted bracket 42. The leading ends of the lengths of tube are slightly flared, as shown, to ensure the smooth flow of rolled product into and through the tubes.

Figure 7:
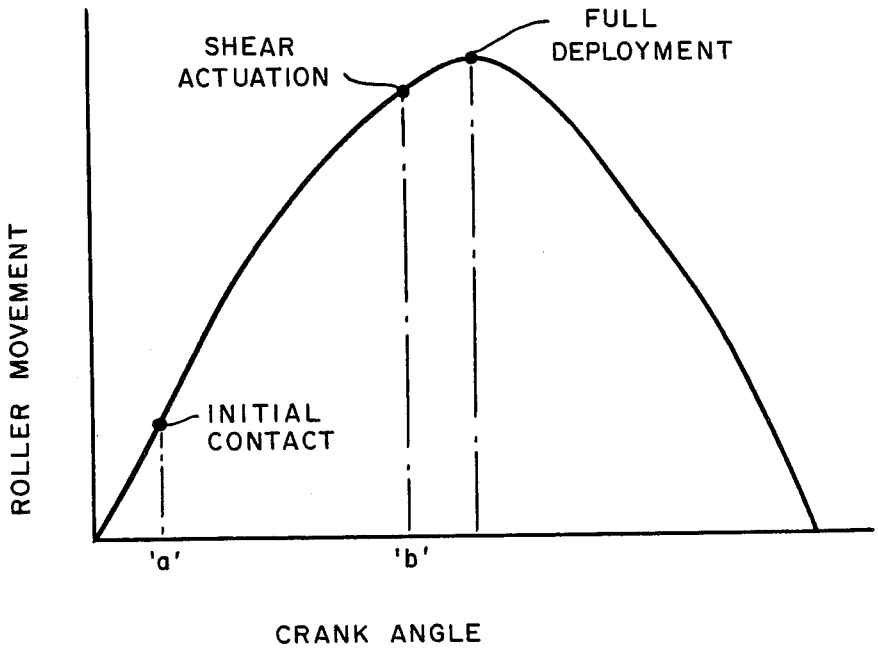
FIG. 7 is a graph illustrating the shear actuation in relation to roller movement.

In the position in which the mechanism is shown in full lines in FIG. 3, and with the crankshafts at angles 'a', the sets of rollers 16 and 18 are shown to be just making contact with the hot rolled product passing between them. In the position in which the mechanism is shown in chain-dotted lines in FIG. 3, the sets of rollers are shown to have moved across the original path of movement of the product to have deformed it (in the sense of having formed a series of bends in it) in a direction perpendicular to its original length and to have brought it to a sinuous shape. It will be seen from the positions of the crankshafts 32 and 34, at angles 'b', that the rollers are still moving across at this instant, but the arrangement is such that at crank angles 'b' the shearing means are operated to shear a leading length of product from a following length of product still being acted on by the final rolling mill stand. Thus, as illustrated in FIG. 7, shear actuation at crank angle 'b' occurs prior to full roller deployment, while the product is still undergoing deceleration caused by the gradually increasing length of the sinuous path defined by the rollers. Simultaneously, the switching means are operated to switch the following length of rolled product into the alternate track for the subsequent deceleration and shearing of a further length of product.

It will be seen that the action of the sets of rollers 16 and 18 on a length of hot rolled product passing between them is to decelerate the leading length of the product relative to a following length of product not being acted on by said rollers. In other words, because the forming of the series of bends takes up a certain amount of length of the rolled product, and the product issues from the mill at a fixed speed, although still travelling forwardly, the leading length of said product is, in effect, smoothly decelerated relative to the length of rolled product still being fed through the finishing stand of the mill. The result is that the leading length of product is decelerated to a significant extend before it has been sheared from the rolled product still passing through the mill, and in a manner not dependent on a frictional retardation of the product or on the frictional gripping of the product between pinch rolls.

It will be understood that at the instant of shearing of the leading length of product from the following length of product still being acted on by the final rolling mill stand, the leading end of said leading length will be travelling at the declerated rate but that the trailing end of said leading length will be travelling at the undecelerated rate of travel of the following length of product. The result of this is that following the shearing of said leading length of product from said following length, some of the kinetic energy of its trailing end portion will be immediately transferred to its leading end portion so that the entire cropped length of product will proceed forwardly at a mean decelerated rate.

The final deceleration of the lengths of product after they have been sheared to length will of course be by way of frictional retardation or by the gripping of the product between pinch rolls, but this will be a relatively small part of the total deceleration required. For example, it is thought that if the speed of the rolled product issuing from the finishing stand of the mill is in the region of, say, 25 meters/sec, the lengths of product can be decelerated to about 7.5 meters/sec or less in apparatus embodying the invention before being sheared. The final deceleration of the sheared lengths of product by conventional apparatus will then not be a problem. The arrangement is of course such that as the initial deceleration means are brought into operation, and the switch means and shearing means then operated simultaneously, the lifting aprons 50 of the track along which the just sheared length of product is passing are lifted to cause the final deceleration of the sheared length.

As shown in FIG. 2, a pair of pinch rolls 44, 46 are provided on the output side of the means for initially decelerating the lengths of product, a driven one, 44 of said pinch rolls being driven at the initially decelerated speed and being retractable, as shown in chain-dotted lines, from contact with the product during the free passage of said product through the apparatus. The pinch rolls can be used for straightening the trailing ends of the lengths of product as they emerge from the apparatus and will also clear the lengths of product from the apparatus if the sliding distance for final deceleration is less than the overall length of the apparatus for effecting the initial deceleration. As previously mentioned, the run off table rollers 48 are adapted to be driven at a speed matching the velocity of the rolled product as it leaves the finishing stand of the rolling mill. The respective sets of lifting aprons 50 which are located along the alternate tracks 12 and 14 along which successive lengths of product emerge from the initial deceleration apparatus are arranged to be lifted, by means not shown, to bring the lengths of product to a halt following their initial deceleration and shearing from the rolled product still passing through the finishing stand of the mill.

Figure 6:
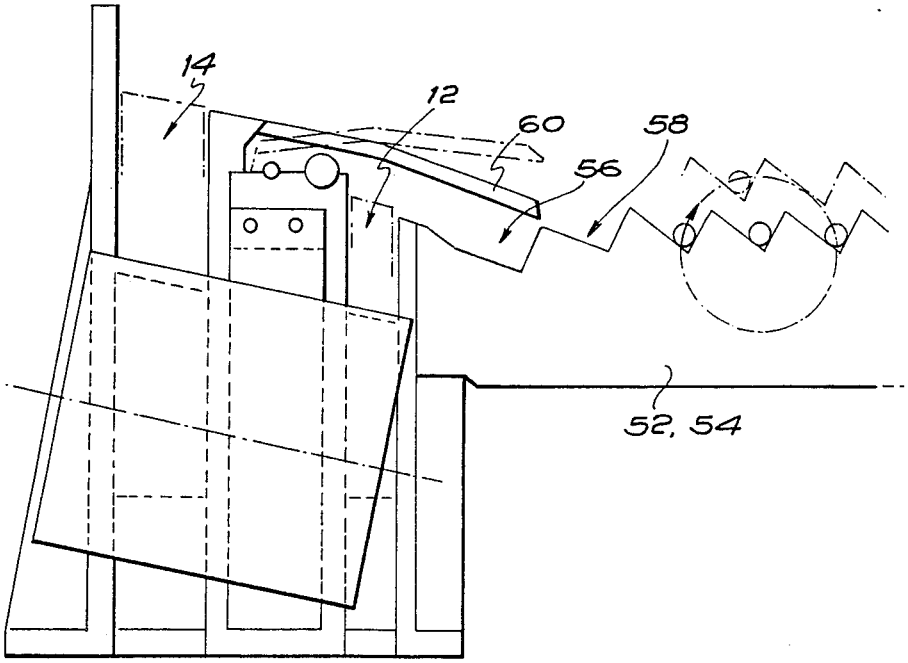
FIG. 6 is a semi-diagrammatic view of walking beam cooling bed apparatus associated with the decelerator apparatus.

Referring now to FIG. 6, the walking beam cooling bed apparatus which is shown associated with the deceleration apparatus just described has sets of walking beams 52,54 with a double pitch walk as illustrated diagrammatically. The arrangement is such that lengths of product can be deposited by the lifting aprons of the adjacent track 12 into a first set of notches 56 of the walking beams and by the lifting aprons of the remote track 14 into a second set of notches 58, the lengths of product being kept separate during subsequent walking of said walking beams. As shown, carry-over plates 60 are provides to enable the lengths of product being lifted by the lifting aprons of the track 14 to be deposited into the second set of notches of the walking beams, said carry-over plates being pivotally mounted to enable them to be displaced, as shown in chain-dotted lines, to permit the operation of the walking beams.

Thus there is provided deceleration apparatus whereby hot rolled product can be decelerated in a manner which overcomes the disadvantages associated with previously known decelerator apparatus. Basically this is because all previously known decelerator apparatus has relied on slowing down the lengths of product after they have been sheared from the product still emerging from the finishing stand of the mill. In apparatus embodying the invention, the deceleration is achieved immediately prior to shearing and therefore does not rely on means for frictionally gripping the trailing ends of the lengths of product or involve an excessive sliding distance of the sheared lengths of product before they are finally brought to rest. The apparatus, in effect, makes use of the rolled product still passing through the final rolling mill stand as an anchor. The greater part of the mass of the length of rolled product about to be sheared to length is, in effect, drawn rearwardly relative to the following length of product immediately prior to shearing. The result is that by the use of apparatus embodying the invention it will be possible to allow hot rolled product of relatively small cross sectional area to issue from the finishing stand of a rolling mill at a velocity far in excess of that which has been possible hitherto.

It will of course be understood that the rate of initial deceleration can be accurately controlled, and can be arranged to be substantially constant, by adjusting the drive geometry and adjusting its speed of operation so as to adjust the rate at which the rollers form the bends in the lengths of product. The pressure of the rollers against the rolled product is much less than that of pinch rolls and will not deform the cross sectional shape of the product. Specially shaped grooves in the rollers, that is to say matching the cross sectional shape of the product, will not be required.

Various modifications may be made. For example, the mechanism for displacing the rollers for forming the bends in the rolled product may be varied in numerous ways. One different way of displacing the rollers for forming the bends in the rolled product would be to mount oppositely disposed but staggered pairs of said rollers on rotatable carriers, the rotatable carriers being spaced apart longtiduinally of the direction of travel of the rolled product as it issued from the final rolling mill stand, said carriers being arranged to be rotated, simultaneously, through pre-determined angles to move the pairs of rollers to positions in which they bring a leading length of the rolled product to a sinuous form. The mechanism need not necessarily be driven by mechanical means, that is to say for example by the contra-rotating crankshafts 32 and 34 of the illustrated embodiment. It could for example be powered by at least one hydraulic ram arranged to displace the connecting rods for moving the bell crank levers of the illustrated embodiment or for displacing a toothed rack or a series of toothed racks engaging toothed segments associated with the rotatable carriers of the possible modification just described, as the case may be. The number of bends being formed to effect the initial deceleration of the product may also be varied, depending upon the lengths of the sheared product and hence their weight. Furthermore, instead of arranging for both sets of rollers to be movable, it may be preferred to hold one set of rollers stationary and to drive the other set of rollers through twice the distance.

I claim:

1. A method of decelerating lengths of hot rolled product issuing from a final rolling mill stand and passing along a track, the method being characterised by the step of bending a leading length of said product by deforming means acting on it in a direction perpendicular to its length to decelerate the leading length of the product relative to a following length of product being acted on by said rolling mill stand; shearing said leading length from said following length whilst said deforming means are still in motion; and switching the following length of rolled product into an alternate track for the subsequent deceleration of a further length of product by the same method.

2. A method of initially decelerating lengths of rolled product as claimed in claim 1, further characterised in that it includes the step of guiding the lengths of rolled product along alternate tracks through lengths of tube articulated together to allow the required deformation of the product in a direction perpendicular to its length.

3. Apparatus for decelerating lengths of hot rolled product issuing from a final rolling mill stand and passing along a track (12), characterised in that it includes means for deforming in the sense of bending a leading length of said product in a direction perpendicular to its length to decelerate the leading length of the product relative to a following length of product being acted on by said rolling mill stand, shearing means (11) for shearing said leading length of product from said following length whilst the means for deforming said leading length of product are still in motion, and switching means (10) for switching the following length of rolled product into an alternate track (14) for the subsequent deceleration and shearing of a further length of product.

4. Apparatus according to claim 3, further characterised in that the means for deforming a leading length of the rolled product in a direction perpendicular to its length includes two sets of rollers (16 and 18) on opposite sides of said leading length of product, the rollers on one side being staggered relative to the rollers on the other side, means being provided for acting on said rollers to move them from positions in which they lie on opposite sides of the rolled product passing in straight line fashion from the final rolling mill stand to positions in which they bring a leading length of said product to a sinuous form.

5. Apparatus according to claim 4, further characterised in that the means provided for acting on the rollers (16 and 18) to move them to positions in which they bring a leading length of the rolled product to a sinuous form are constituted by respective sets of bell crank levers (20,22) linked together for simultaneous movement by respective connecting rods (28 and 30).

6. Apparatus according to claim 4, further characterised in that the means provided for acting on the rollers (16,18) to move them to positions in which they bring a leading length of the rolled product to a sinuous form are constituted by a plurality of rotatable carriers each of which carry an oppositely disposed but staggered pair of said rollers, said carriers being spaced apart longitudinally of the direction of travel of the rolled product as it issues from the final rolling mill stand (S) and being arranged to be rotated, simultaneously, through pre-determined angles.

7. Apparatus according to any one of claims 3 to 6, further characterised in that it includes guiding means for guiding the lengths of rolled product along the alternate tracks, said guiding means being constituted by lengths of tube (36) articulated together to allow the required deformation of the product in a direction perpendicular to its length.

8. Apparatus according to claim 7, further characterised in that a leading end of each length of tube (36) is connected by means of a pivot bracket (38) to the spindly (40) of a preceding roller being one of the two sets of rollers (16 and 18) on opposite sides of the product which can act on said product and deform it as it issues from the rolling mill, a trailing end of each length of tube (36) having sliding connection with the spindle (40) of the next successive roller by means of a slotted bracket (42).

9. Apparatus according to claim 8, further characterised in that it includes a pair of pinch rolls (44,46) on the output side of the means for deforming a leading length of the hot rolled product in a direction perpendicular to its length, a driven one (44) of said pinch rolls being driven at the decelerated speed and being retractable from contact with the product during the free passage of said product through the apparatus whereby the pinch rolls can be used for straightening the trailing ends of the lengths of product as they emerge from the apparatus and will also clear the lengths of product from the apparatus if the sliding distance for final deceleration is less than the overall length of the apparatus.

10. Apparatus according to claim 9, further characterised in that it includes a plurality of continuously driven run off table rollers (48) adapted to be driven at mill speed at the output side of the deceleration apparatus, respective sets of lifting aprons (50) being located along the alternate tracks (12 and 14) along which successive lengths of product emerge from the deceleration apparatus, said lifting aprons being arranged to be lifted to bring the lengths of product to a halt following their deceleration in said apparatus and shearing from the rolled product still passing through the finishing stand of the mill.

11. Apparatus according to claim 10 further characterised in that a walking beam cooling bed is arranged alongside the run off table, the walking beams (52,54) having a double pitch walk so that lengths of product can be deposited by the lifting aprons (50) of the adjacent one of the alternate tracks into a first set (56) of notches of the walking beams and by the lifting aprons (50) of the remote one of the alternate tracks into a second set (58) of the notches, the lengths of product being kept separate during subsequent walking of said walking beams, carry-over plates (60) being provided to enable the lengths of product being lifted by the lifting aprons (50) of the remote one of the alternate tracks to be deposited into the second set (59) of notches of the walking beams, said carry-over plates being pivotally mounted to enable them to be displaced to permit the operation of the walking beams (52,54).

* * * * *